US006662783B2

(12) United States Patent
Augustin et al.

(10) Patent No.: US 6,662,783 B2
(45) Date of Patent: Dec. 16, 2003

(54) DIGITAL VALVE

(75) Inventors: Ulrich Augustin, Blythewood, SC (US); Robert Straub, Lowell, MI (US)

(73) Assignee: Siemens Diesel Systems Technology, Blythwood, SC (US)

( * ) Notice: Subject to any disclaimer, the term of this patent is extended or adjusted under 35 U.S.C. 154(b) by 77 days.

(21) Appl. No.: 10/106,123

(22) Filed: Mar. 27, 2002

(65) Prior Publication Data

US 2003/0075153 A1 Apr. 24, 2003

Related U.S. Application Data

(63) Continuation-in-part of application No. 09/983,037, filed on Oct. 22, 2001.
(60) Provisional application No. 60/336,708, filed on Dec. 7, 2001.

(51) Int. Cl.[7] ..... F02M 37/04
(52) U.S. Cl. ..... 123/446; 251/129.1
(58) Field of Search ..... 251/129.1; 123/446; 335/256

(56) References Cited

U.S. PATENT DOCUMENTS 3,792,390 A * 2/1974 Boyd ..... 335/229
4,247,052 A * 1/1981 Gray ..... 239/585
4,559,511 A * 12/1985 Basnett et al. ..... 335/132
4,928,028 A * 5/1990 Leibovich ..... 335/266
5,954,030 A * 9/1999 Sturman et al. ..... 123/446
6,163,239 A * 12/2000 Ozawa et al. ..... 335/256
6,494,187 B2 * 12/2002 Giavi et al. ..... 123/490

* cited by examiner

*Primary Examiner*—Thomas N. Moulis
(74) *Attorney, Agent, or Firm*—McGuireWoods LLP

(57) ABSTRACT

A control valve for a fuel injector generally includes a valve body and a spool positioned within a bore of said valve body. The spool is slideable between a first and second position. The control valve also comprises a first bore in fluid communication with a rail inlet of the fuel injector, a cross bore positioned within the valve body and offset from the first bore, and a groove located about the spool. The groove provides fluid communication between the cross bore and the first bore when the spool is in the first position, and seals fluid communication when the spool is in the second position. At least two solenoids are provided on opposing sides of the spool for moving the spool between the first and second positions, and a non-magnetic barrier is provided between the solenoids and the spool.

15 Claims, 7 Drawing Sheets

DIGITAL VALVE

CROSS-REFERENCE TO RELATED APPLICATIONS

This application claims priority under 35 U.S.C. §§119(e) and 120 of U.S. Provisional Patent Application Ser. No. 60/336,708, filed Dec. 7, 2001, and is a continuation-in-part of U.S. patent application Ser. No. 09/983,037, filed Oct. 22, 2001, the contents of which are hereby incorporated by reference.

BACKGROUND OF THE INVENTION

1. Field of the Invention

The present invention generally relates to an oil activated fuel injector. More particularly, the present invention relates to a digital control valve used with an oil activated, electronically or mechanically controlled fuel injector.

2. Background Description

There are many types of fuel injectors designed to inject fuel into a combustion chamber of an engine. For example, fuel injectors may be mechanically, electrically, or hydraulically controlled in order to inject fuel into the combustion chamber of the engine. In the hydraulically actuated systems, a control valve body may be provided with two-, three-, or four-way valve systems, each having grooves or orifices that allow fluid communication between working ports, high pressure ports, and venting ports of the control valve body of the fuel injector and the inlet area. The working fluid is typically engine oil or other types of suitable hydraulic fluid that is capable of providing a pressure within the fuel injector in order to begin the process of injecting fuel into the combustion chamber.

In current designs, a driver will deliver a current or voltage to an open side of an open coil solenoid. The magnetic force generated in the open coil solenoid will shift a spool into the open position so as to align grooves or orifices (hereinafter referred to as "grooves") of the control valve body and the spool. The alignment of the grooves permits the working fluid to flow into an intensifier chamber from an inlet portion of the control valve body (via working ports). The high pressure working fluid then acts on an intensifier piston to compress an intensifier spring and hence compress fuel located within a high pressure plunger chamber. As the pressure in the high pressure plunger chamber increases, the fuel pressure will begin to rise above a needle check valve opening pressure. At the prescribed fuel pressure level, the needle check valve will shift against the needle spring and open the injection holes in a nozzle tip. The fuel will then be injected into the combustion chamber of the engine.

However, in such a conventional system, a response time between the injection cycles may be slow, thus decreasing the efficiency of the fuel injector. This is mainly due to the slow movement of the control valve spool. More specifically, the slow movement of the control valve may result in a slow activation response time to begin the injection cycle. To remedy this inadequacy, additional pressurized working fluid may be needed; however, additional energy from the high pressure oil pump must be expended in order to provide this additional working fluid. This leads to an inefficiency in the operations of the fuel injector itself. Also, the working fluid at an end of an injection cycle may not be vented at an adequate response rate due to the slow movement of the control valve spool.

Other prior art systems use a small step at the end of the spool to reduce the area where the spool and the solenoid are in contact. However, these steps introduce wear due to impact between parts and reduced magnetic force between the spool and the solenoids.

SUMMARY OF THE INVENTION

According to a first aspect of the invention, a control valve for a fuel injector generally includes a valve body and a spool positioned within a bore of said valve body. The spool is slideable between a first and second position. The control valve also comprises a first bore in fluid communication with a rail inlet of the fuel injector, a cross bore positioned within the valve body and offset from the first bore, and a groove located about the spool. The cross bore, in embodiments, leads to ambient, and the first bore may be located within the valve body. The groove provides fluid communication between the cross bore and the first bore when the spool is in the first position, and seals fluid communication when the spool is in the second position. At least two solenoids are provided on opposing sides of the spool for moving the spool between the first and second positions, and a non-magnetic barrier is provided for controlling latching forces between the spool and at least one of the at least two solenoids when the spool is in the first position or the second position. The latching forces are created by a current pulse of one of the at least two solenoids. In embodiments, the solenoids are provided in end caps. The non-magnetic barrier may be a non-magnetic shim or a non-magnetic coating, and is preferably selected based upon the required or developed latching forces between the spool and the solenoids.

DETAILED DESCRIPTION OF A PREFERRED EMBODIMENT OF THE INVENTION

The present invention is directed to an oil activated, electronically, mechanically, or hydraulically controlled fuel injector, and more particularly to a digital control valve used with an oil activated fuel injector. The digital control valve of the present invention is capable of providing a short control valve stroke that, in turn, translates into a fast response time for the outflow of the inlet rail pressure. The oil activated fuel injector of the present invention will thus increase efficiency of the injection cycle.

Embodiments of the Oil Activated Fuel Injector of the Present Invention

Figure 1:
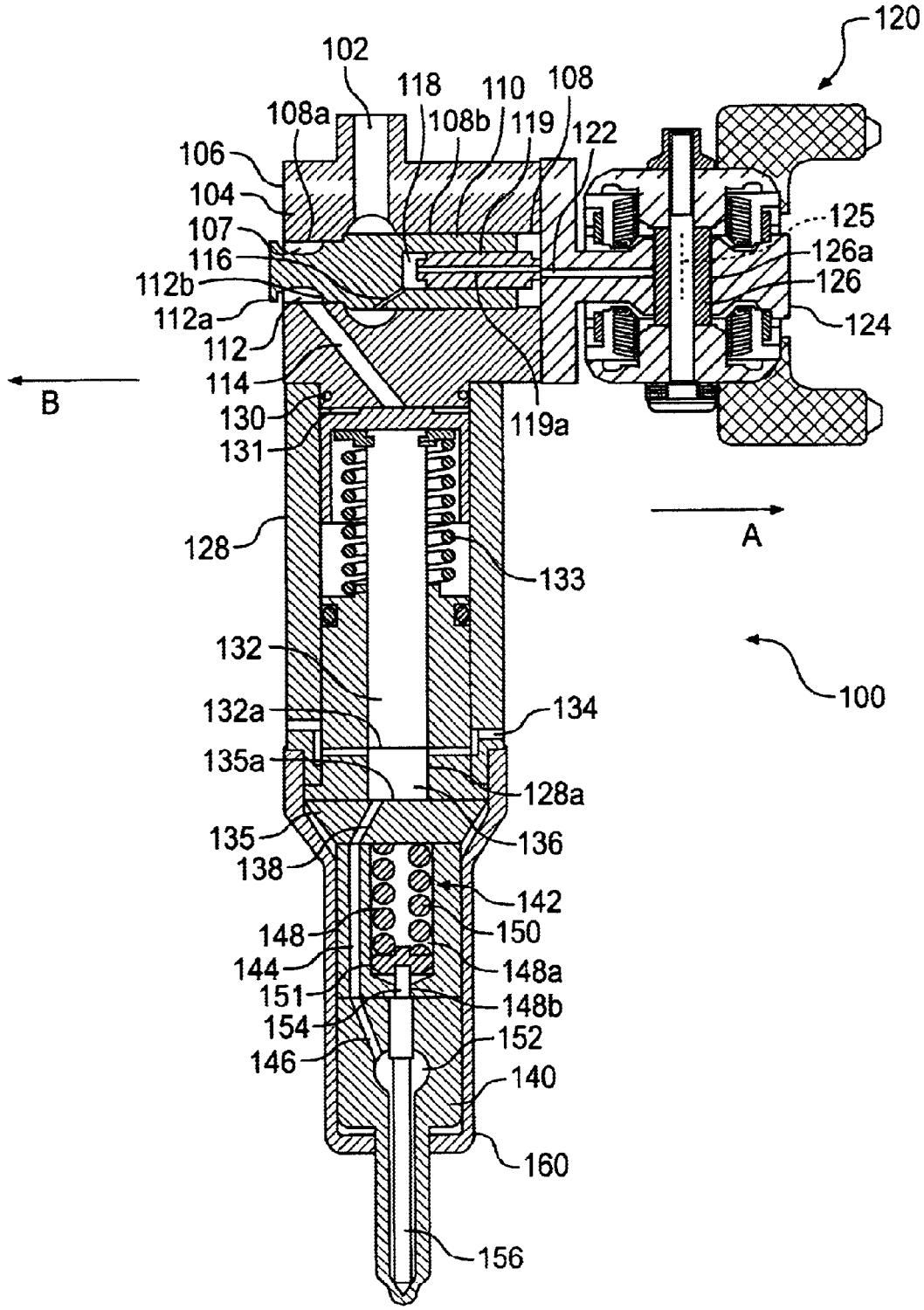
FIG. 1 shows an oil activated fuel injector used with a control valve according to the present invention.

Referring now to FIG. 1, the fuel injector is generally depicted as reference numeral 100 and includes an inlet port 102, which receives working fluid, for example engine lubricant, from an inlet rail (not shown). The fuel injector 100 also includes a body 104 having a flat body area 106 and a central bore 108. The central bore 108 includes a first diameter 108*a* and a second diameter 108*b*. In embodiments, the first diameter 108*a* is slightly smaller than the second diameter 108*b*. A spool 110 is slidably positioned within the central bore 108 and includes a groove 112 positioned within the first diameter 108*a*. The groove includes a first leading edge 112*a* and a second leading edge 112*b*, and provides fluid communication between the inlet port 102 and the bore or working port 114, which leads to the intensifier chamber. A venting space 107 is developed between the first leading edge 112*a* and the flat body area 106 in the position of the spool 110 of FIG. 1. It should be recognized by those of ordinary skill in the art that the venting space 107 is sealed when the spool 110 is moved in the direction of arrow "A." As discussed in more detail below, the working fluid in the intensifier chamber is allowed to vent via the space 107 at the termination of the injection cycle.

The spool 110 further includes a throttle 116, which provides fluid communication between the inlet port 102 and a pressure chamber 118. The pressure chamber 118 is defined by a partial bore 118*a* within the spool 110 and a servo piston 119. The servo piston 119 is partly located within the partial bore 118*a* and further includes a central bore 119*a*. The central bore 119*a* is in fluid communication with the pressure chamber 118, which provides, in part, a mechanism for the working fluid to be vented to ambient during an initial stage of the injection cycle.

Still referring to FIG. 1, a control valve 120 includes a spool body 124 (also referred to as a control valve body or valve body) having a bore 122 in axial alignment with the central bore 119*a* of the servo piston 119. The spool body 124 also includes a cross bore 125 leading to ambient. A spool 126, slidably positioned within the spool body 124, includes a groove 126*a*, which, in a first, or activated, position of the spool 126, overlaps with the bore 122 and the cross bore 125 to provide fluid communication therebetween. In turn, this position of the groove 126*a* (that is, when the spool 126 is activated) provides a flow path for the working fluid from the inlet port 102 to ambient via (i) the inlet port 102; (ii) the throttle 116; (iii) the pressure chamber 118; (iv) the central bore 119*a*; (v) the bore 122; (vi) the groove 126*a*; (vii) the cross bore 125; and (viii) ambient. At this pressure stage, the pressure within the pressure chamber 118 will be substantially equal to that of the inlet rail pressure.

In more particularity, in a first, or activated, position of the spool 126, the groove 126*a* overlaps both the bore 122 and the cross bore 125. In this position, the pressure within the pressure chamber 118 will be lower than that of the inlet rail pressure, which, in turn, allows the slideable spool 110 to move in the direction of arrow "A." At this spool 110 position, the first leading edge 112*a* is positioned within the inside edge of the flat body area 106 (that is, within the central bore 108), thus sealing the venting space 107. This allows working fluid to flow from the inlet port 102 through the bore 114 and into the intensifier body in order to begin an injection cycle.

In a second, or deactivated, position of the spool 126, the groove 126*a* no longer overlaps with the bore 122 and the cross bore 125, and hence will not lead the working fluid to ambient. In this spool 110 position, the working fluid will flow from the inlet port 102 to the pressure chamber 118 via the throttle 116. This will increase the pressure within the pressure chamber 118 to a pressure which is substantially equal to that of the inlet rail pressure. In turn, this increased or higher pressure will force the slideable spool 110 to move in the direction of arrow "B" to a second position, thus moving the first leading edge 112*a* beyond the outside edge of the flat body area 106, and hence forming the venting space 107. The working fluid within the intensifier chamber will be vented to ambient via the venting space 107, thus ending the injection cycle.

FIG. 1 further shows the remaining portions of the fuel injector 100 used with the control valve 120 of the present invention. It should be understood by one skilled in the art that the control valve 120 of the present invention may equally be used with other configurations of fuel injector 100. By way of example only, and without limitation, these other configurations may include a ball valve mechanism at the fuel inlet or other angled or straight bores leading to the nozzle of the injector 100.

An intensifier body 128 is mounted to the body 104 via any conventional mounting mechanism. A seal 130, for example, an o-ring, may be positioned between the mounting surfaces of the intensifier body 128 and the body 104. A piston 131 is slidably positioned within the intensifier body 128 and is in contact with an upper end of a plunger 132. An intensifier spring 133 surrounds a portion (e.g., shaft) of the plunger 132 and is further positioned between the piston 131 and a flange or shoulder formed on an interior portion of the intensifier body 128. The intensifier spring 133 urges the piston 131 and the plunger 132 in a first position proximate to the body 104.

As further seen in FIG. 1, a fuel inlet 134 is formed within the intensifier body 128 proximate an end portion 132*a* of the plunger 132. The fuel inlet 134 provides fluid communication between a high pressure chamber 136 and a fuel area (not shown). This fluid communication allows fuel to flow into the high pressure chamber 136 from the fuel area during an up-stroke of the plunger 132. A check disk 135 is positioned below the intensifier body 128 remote from the inlet port 102. The combination of an upper surface 135*a* of the check disk 135, the end portion 132*a* of the plunger 132, and an interior wall 128*a* of the intensifier body 128 forms the high pressure chamber 136. The check disk 135 also includes a fuel bore 138 in fluid communication with the high pressure chamber 136.

FIG. 1 further shows a nozzle 140 and a spring cage 142. The spring cage 142 is positioned between the nozzle 140 and the check disk 135, and includes a fuel bore 144 in fluid communication with the fuel bore 138 of the check disk 135. The spring cage 142 also includes a centrally located bore 148 having a first bore diameter 148*a* and a second, smaller bore diameter 148*b*. A spring 150 and a spring seat 151 are positioned within the first bore diameter 148*a* of the spring cage 142, and a pin 154 is positioned within the second, smaller bore diameter 148*b*.

The nozzle 140 includes an angled bore 146 in alignment with the bore 144 of the spring cage 142. A needle 156 is preferably centrally located within the nozzle 140 and is urged downwards by the spring 150 via the pin 154. A fuel heart chamber 152 surrounds the needle 156 and is in fluid communication with the bore 146. In embodiments, a nut 160 is threaded about the intensifier body 128, the check disk 135, the nozzle 140, and the spring cage 142.

Figure 2:
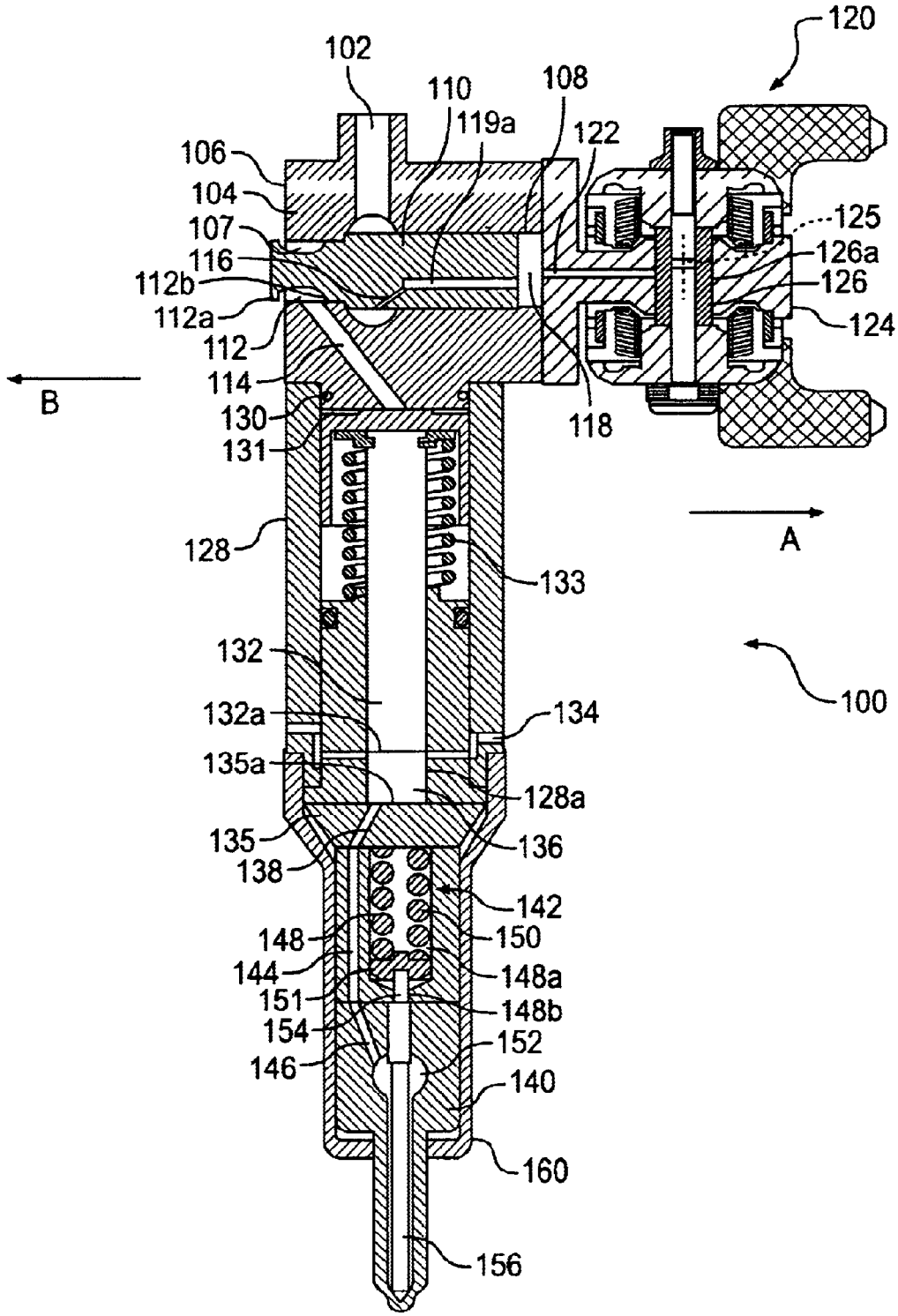
FIG. 2 shows an embodiment of the present invention.

FIG. 2 shows an embodiment of the present invention. In this embodiment, the high pressure chamber 118 is positioned between the end of the spool 110 and the valve body 124. That is, a portion of the central bore 108 forms the high pressure chamber 118 between the spool 110 and the valve body 124. The bore 119*a* is located within the spool 110 and provides fluid communication between the high pressure chamber 118 and the throttle 116. The embodiment of FIG. 2 further shows the high pressure chamber 118 in fluid communication with the bore 122, with all of the remaining features and advantages substantially the same ad the embodiment of FIG. 1.

As to the advantages and remaining features, it is noted by way of example only that in a first, or activated, position of the spool 126, the slidable spool 110 will move in the direction of arrow "A" such that the first leading edge 112*a* is positioned within the inside edge of the flat body area 106. As previously discussed, this allows working fluid to flow in to the intensifier body in order to begin an injection cycle. In a second, or deactivated, position of the spool 126, working fluid will flow into the pressure chamber 118, thus increasing the pressure therein to a higher pressure than that of the inlet rail pressure. This is due to the fact that the groove 126*a* is no longer overlapping with the bore 122 and the cross bore 125, and hence will not lead to ambient. In turn, this higher pressure will force the slidable spool 110 top move in the direction of arrow "B," thus allowing the working fluid to vent from the intensifier chamber to ambient via the space 107 provided between the flat body 106 and the first leading edge 112*a*.

Figure 3A:
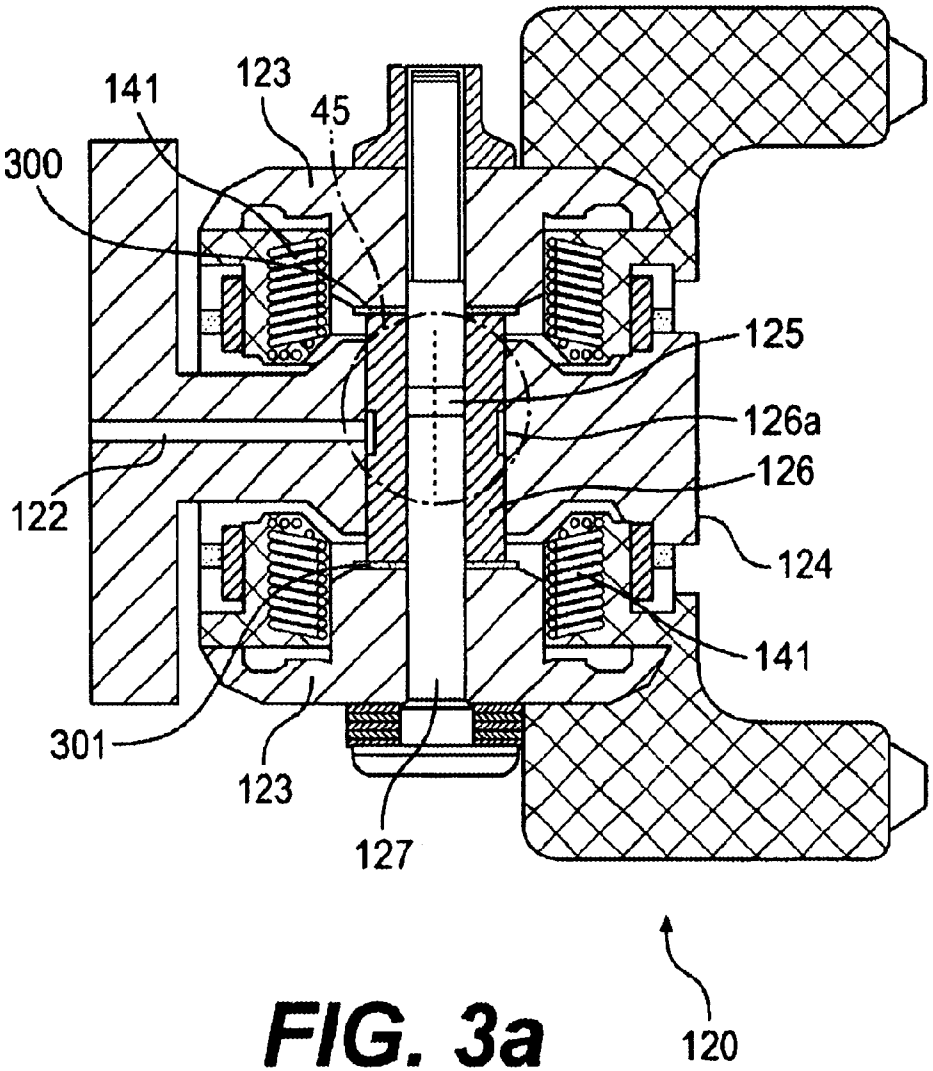
FIG. 3*a* shows an exploded view of the control valve of the present invention.

FIG. 3*a* is an exploded view of the control valve 120 of the present invention. In this view, it is readily seen that the control valve 120 of the present invention includes the valve body 124 having the bore 122 and the cross bore 125. Also, the spool 126 is slidably positioned within the spool body 124, and includes a groove 126*a* that provides fluid communication between the bore 122 and the cross bore 125 when the spool 126 is in the first position. The control valve body also includes end caps 123 mounted to the control valve body 124 via a nut and bolt mechanism 127 or other mounting mechanism. A pair of coils 141 (e.g., solenoids) are used to activate and deactivate the spool 126 between the first, or open, position and the second, or closed, position, respectively. By a short current pulse of a coil 141, the spool 126 will change positions, moving towards the activated coil 141 and remaining there by latching forces. A high latching force will delay the switching process, while a very low latching force will not guarantee that the spool 126 will stay in position.

Figure 3B:
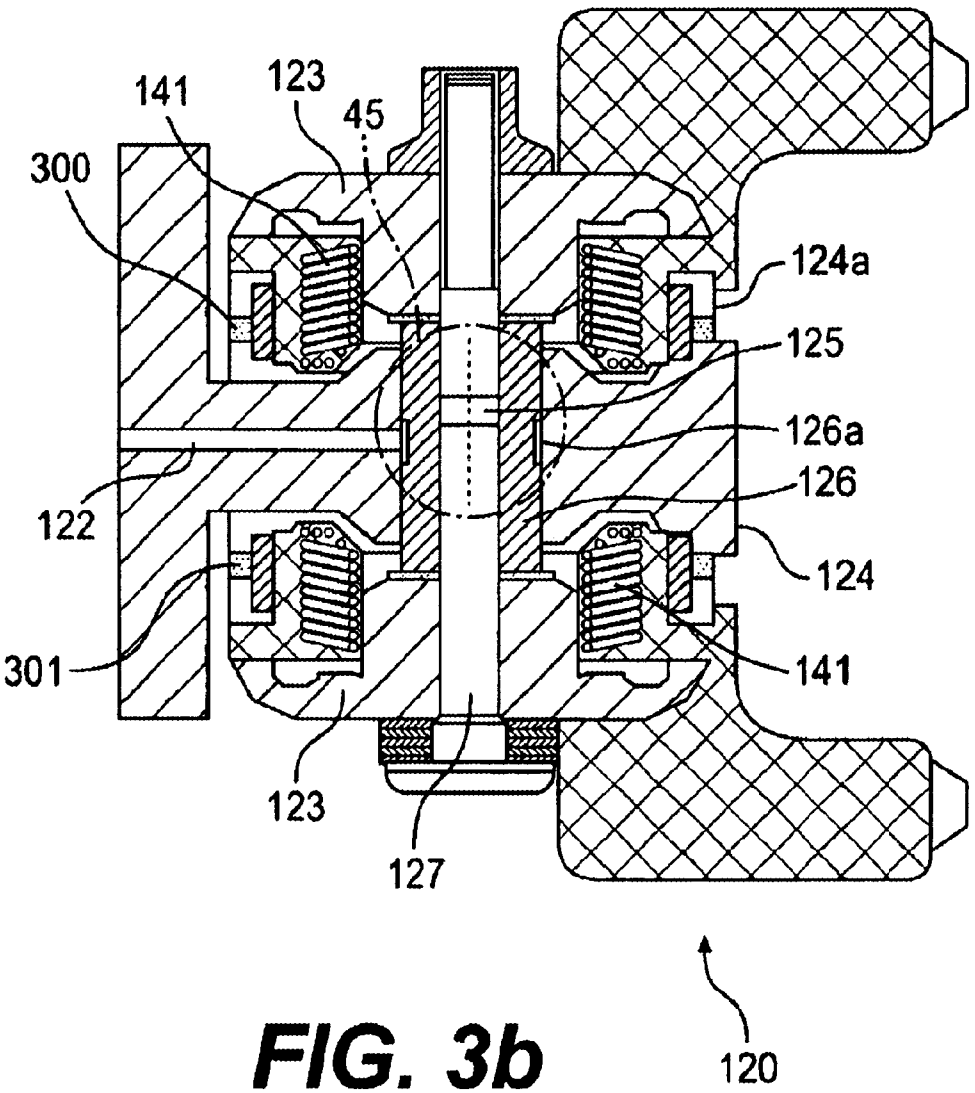
FIG. 3*b* shows an exploded view of an embodiment of the control valve body of the present invention.

In embodiments, the valve control body (spool body) 124 is further provided with non-magnetic shims 300 and 301 between the spool 126 and the coils 141. Preferably, non-magnetic shims 300, 301 are made of stainless steel and are between 10 and 60 microns in thickness. Alternatively, a non-magnetic coating (e.g., ceramic, chrome, etc.) could be used at ends of the spool 126 or on the inner pole of the coils 141 (FIG. 3*a*). In further embodiments, as shown in FIG. 3*b*, the non magnetic coatings or shims 300, 301 may be on the outer pole between the end cap 124*a* and the spool body 124. In this case, the non magnetic coating would no longer be required at ends of the spool 126 or on the inner pole of the coils. Thus, the present invention provides a large contact surface between the spool 126 and the coils 141. This allows for less wear and improved durability of the control valve 120. Furthermore, greater control over the latching forces is advantageously achieved, as the thickness of nonmagnetic shims 300, 301 or non-magnetic coatings is easily controlled in response to variations in the developed or required latching force.

Figure 4:
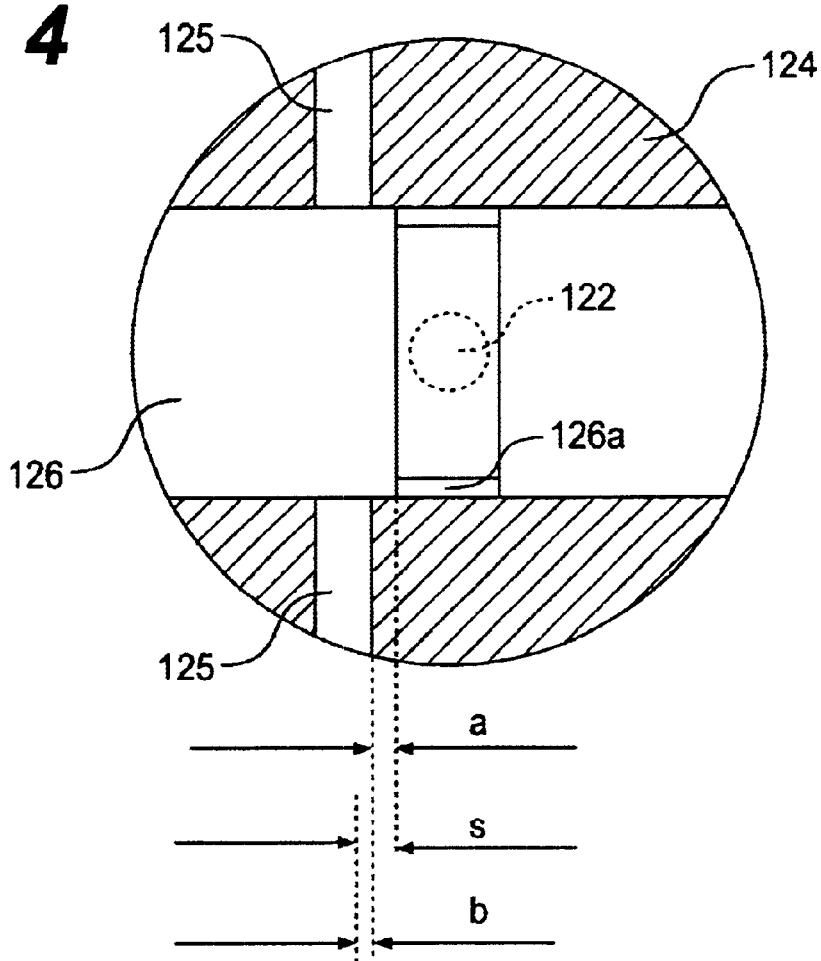
FIG. 4 shows an exploded view of the control valve of the present invention in a closed position.
Figure 5:
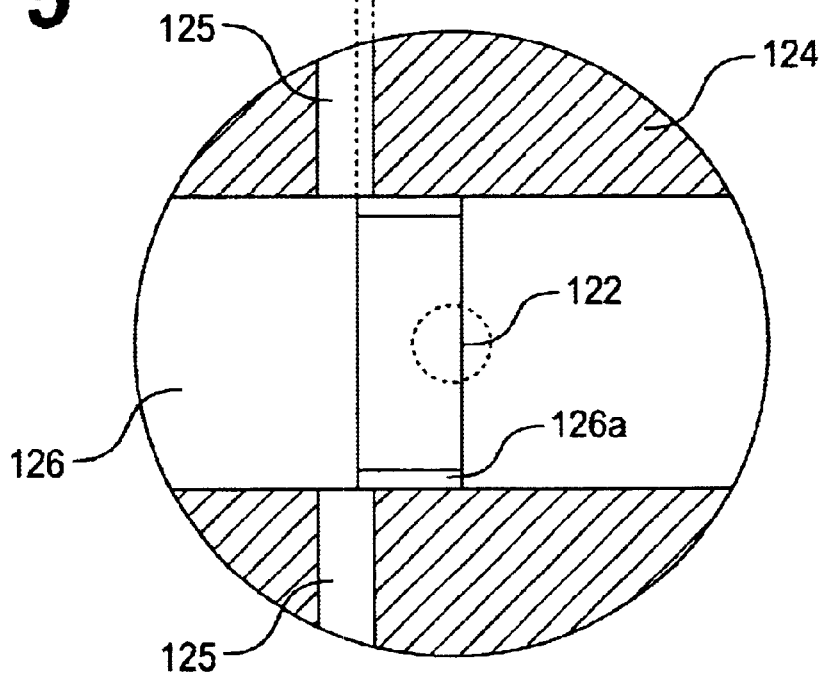
FIG. 5 shows an exploded view of the control valve of the present invention in an open position.

FIGS. 4 and 5 are exploded views of circle 45 in FIG. 3. In FIG. 4, the groove 126*a* is offset from the cross bore 125 by a distance "a" when the spool 126 is in the closed, or deactivated, position. In FIG. 5, the groove 126*a* overlaps with the cross bore 125 by a distance "b" when the spool 126 is in the activated, or open, position. In the activated position, the groove 126*a* is also in fluid communication with the bore 122. As seen in FIGS. 4 and 5, the groove 126*a* moves a total distance "s" between the open and closed positions of the spool 126.

Figure 6:
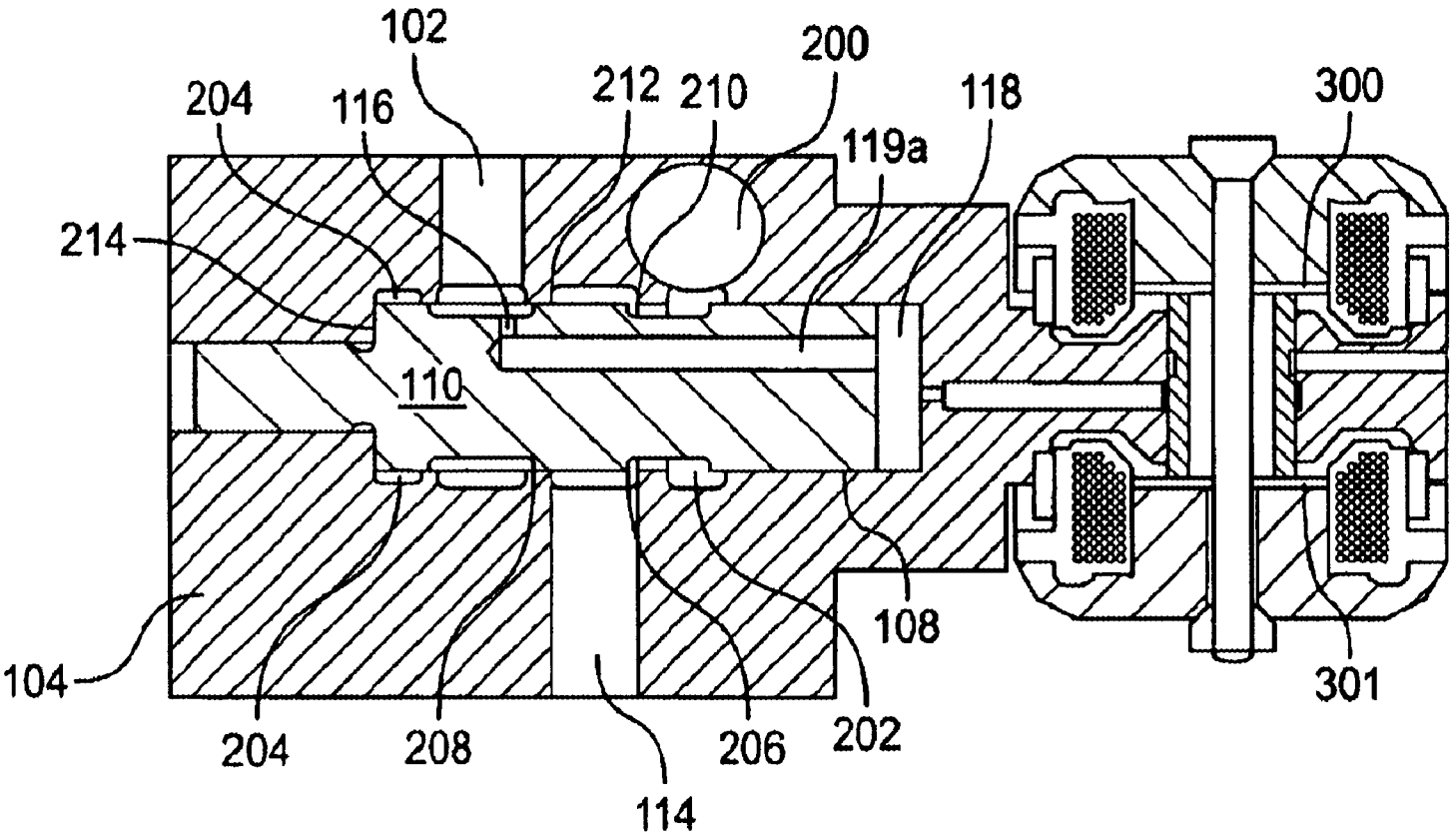
FIG. 6 shows an embodiment of the valve body with a spool in a first position used with the control valve of the present invention.

FIG. 6 shows an embodiment of the valve body used with the control valve of the present invention. In this embodiment, the body 104 includes a larger diameter central bore 108, which provides more flow area for the working fluid. The body 104 further includes a cross bore 200 (leading to ambient), which has a connection to groove 202. A front portion 204 of the spool 110 acts as a guide with a small passage to prevent piston effects. Control edges 206 and 208 of the spool 110 and control edges 210 and 212 of the body 104 are also provided. A ledge or stepped portion 214 is also provided in the valve body 108.

Figure 7:
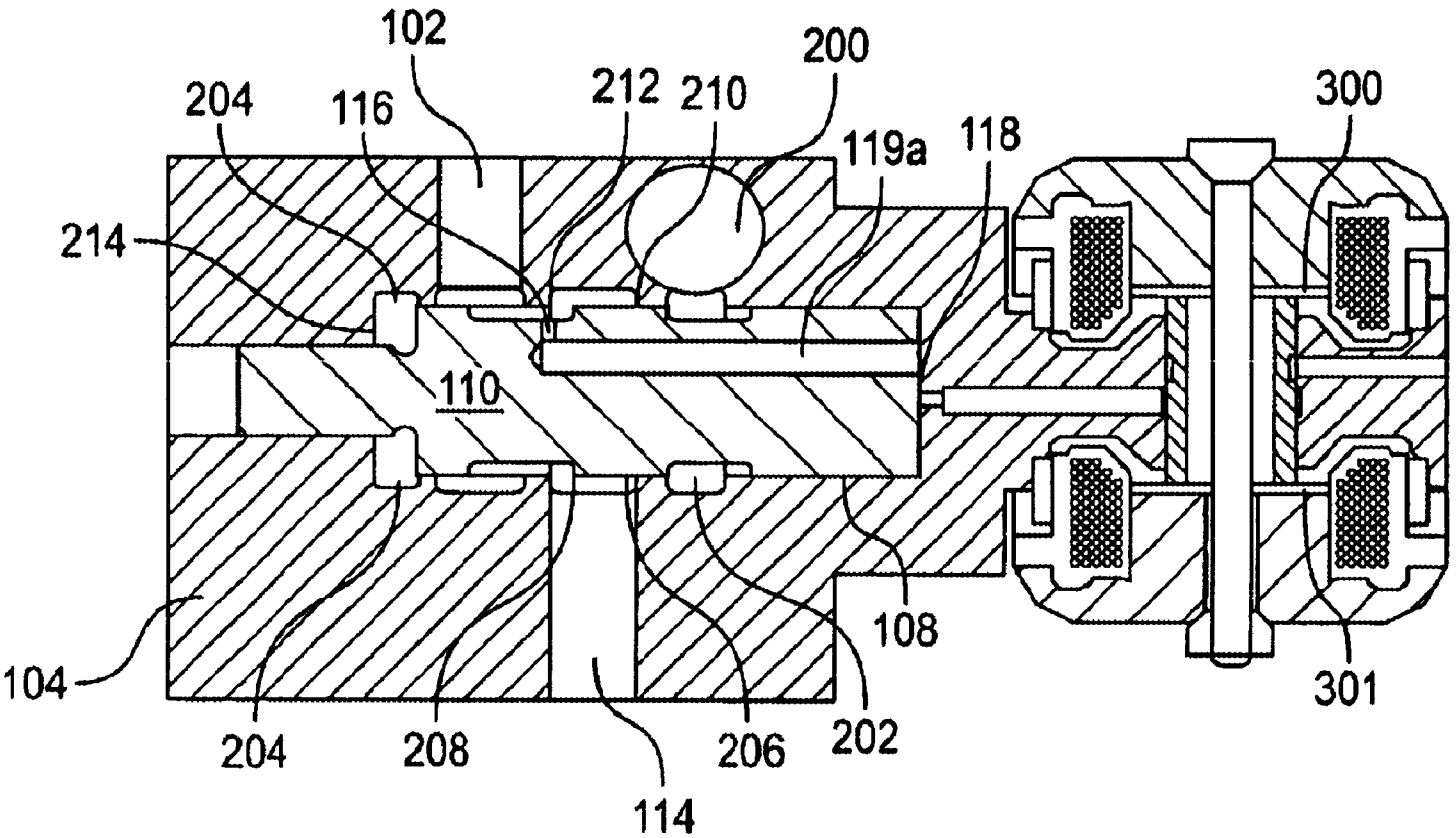
FIG. 7 shows the embodiment of the valve body with a spool in a second position used with the control valve of the present invention.

As shown in FIG. 6, the control edge 206 is aligned with an edge of the groove 202, and the control edge 212 is aligned with the working port 114. In this position (that is, a second position), the return oil from the intensifier piston is in fluid communication with ambient via the bore 114, the spool control edge 206, the body control edge 210 to the groove 202, and cross bore 200. As shown in FIG. 7, to activate, the injection control valve opens to ambient so that the pressure in the space 118 drops. The spool then moves to the right, providing a connection between the inlet port 102 and the working port 114 by the control edges 212 of the body 104 and the control edge 208 of the spool 110. The advantage of this embodiment is a larger flow area for given dimensions and less oil consumption to control the spool 110. Additionally, the stop position (FIG. 6) is better defined with the stepped portion 214. The closed position can also be more easily adjusted using shims (not shown).

Operation of the Oil Activated Fuel Injector of the Present Invention

In operation, a driver (not shown) will first energize a coil 141. The energized coil 141 will then shift the spool 126 to an open position. In the open position, the groove 126*a* will overlap with the bore 122 and the cross bore 125. This provides a fluid path for the working fluid to flow from the inlet port to ambient. In this position, the working fluid pressure within the pressure chamber 118 should be much lower than the rail inlet pressure. At this pressure stage, the spool 110 moves in the direction of arrow "A," thus sealing the venting space 107. This will allow the working fluid to flow between the inlet port 102 and the intensifier chamber via the working port 114.

Once the pressurized working fluid is allowed to flow into the working port 114, it begins to act on the piston 131 and the plunger 132. That is, the pressurized working fluid will begin to push the piston 131 and the plunger 132 downwards, thus compressing the intensifier spring 133. As the piston 131 is pushed downwards, fuel in the high pressure chamber 136 will begin to be compressed via the end portion 132*a* of the plunger 132. A quantity of compressed fuel will be forced through e bores 138, 144, 146 into the heart chamber 152 surrounding the needle 156. As the pressure increases further still, the fuel pressure will rise above a needle check valve opening pressure until the needle spring 150 is urged upwards. At this stage, the injection holes are open in the nozzle 140, thus allowing a main fuel quantity to be injected into the combustion chamber of the engine.

To end the injection cycle, the driver will energize the closed coil 141. The magnetic forced generated in the coil 141 will shift the spool 126 into the closed position, which, in turn, will offset the groove 126*a* from the cross bore 125 (FIG. 4). At this stage, the pressure will begin to increase in the pressure chamber 118, forcing the spool 110 in the direction of arrow "B." This will open the venting space 107 between the flat body area 106 and the leading edge 112*a* of the spool 110. Also, the inlet port 102 will no longer be in fluid communication with the working port 114 and intensifier chamber. The working fluid within the intensifier chamber will then be vented to ambient, and the needle spring 150 will urge the needle 156 downward towards the injection holes of the nozzle 140, thereby closing the injection holes. Similarly, the intensifier spring 133 will urge the plunger 132 and the piston 131 into the closed, or first, position adjacent to the control valve 120. As the plunger 132 moves upwards, fuel will again begin to flow into the high pressure chamber 136 of the intensifier body.

While the invention has been described in terms of its preferred embodiment, those skilled in the art will recognize that the invention can be practiced with modifications within the spirit and scope of the appended claims. Thus, it is intended that all matter contained in the foregoing description or shown in the accompanying drawings shall be interpreted as illustrative rather than limiting, and the invention should be defined only in accordance with the following claims and their equivalents.

What is claimed is:

1. A control valve for a fuel injector, comprising:

a valve body;

a spool positioned within a bore of said valve body and slidable between a first position and a second position;

a first bore in fluid communication with a rail inlet of the fuel injector;

a cross bore positioned within said valve body and offset from said first bore;

a groove located about the spool, said groove providing fluid communication between said cross bore and said first bore when said spool is in the first position and sealing fluid communication between said first bore and said cross bore when said spool is in the second position;

at least two solenoids on opposing sides of said spool for moving said spool between the first and second positions; and a non-magnetic barrier for controlling latching forces between said spool and at least one of said at least two solenoids when said spool is in the first position or the second position, said latching forces being created by a current pulse of one of said at least two solenoids.

2. The control valve according to claim 1, wherein said cross bore leads to ambient.

3. The control valve according to claim 1, wherein said at least two solenoids are provided in at least two end caps.

4. The control valve according to claim 1, wherein said first bore is located within said valve body.

5. The control valve according to claim 1, wherein said control valve controls a flow of working fluid to the fuel injector.

6. The control valve according to claim 1, wherein said non-magnetic barrier is a non-magnetic shim located between said at least two solenoids and said spool.

7. The control valve according to claim 6, wherein said non-magnetic shim is stainless steel.

8. The control valve according to claim 1, wherein said non-magnetic barrier is a non-magnetic coating on at least one of said at least two solenoids and said spool.

9. The control valve according to claim 8, wherein said non-magnetic coating is selected from the group consisting of ceramic and chrome.

10. The control valve according to claim 1, wherein a thickness of said non-magnetic barrier is selected based upon latching forces between said at least two solenoids and said spool.

11. The control valve according to claim 10, wherein the thickness of said non-magnetic barrier is between 10 and 60 microns.

12. The control valve according to claim 1, wherein said non-magnetic barrier is provided between one of (i) said at least two solenoids and said spool and (ii) between end caps and said valve body.

13. A fuel injector, comprising:

a fuel injector body portion; and a control valve for controlling a flow of a working fluid to said fuel injector body portion, said control valve comprising:

a valve body;

a spool positioned within a bore of said valve body and slidable between a first position and a second position;

a first bore in fluid communication with a rail inlet of the fuel injector;

a cross bore positioned within said valve body and offset from said first bore;

a groove located about the spool, said groove providing fluid communication between said cross bore and said first bore when said spool is in the first position and sealing fluid communication between said first bore and said cross bore when said spool is in the second position;

at least two solenoids for moving said spool between the first and second positions; and a non-magnetic barrier for controlling latching forces between said spool and at least one of said at least two solenoids when said spool is in the first position or the second position, said latching forces being created by a current pulse of one of said at least two solenoids.

14. The fuel injector of claim 13, wherein said non-magnetic barrier is provided between said at least two solenoids and said spool.

15. The fuel injector of claim 13, wherein said non-magnetic barrier is provided between end caps associated with the at least two solenoids and said valve body.

* * * * *